United States Patent [19]

Sirén

[11] 4,350,173

[45] Sep. 21, 1982

[54] FILTER MATERIAL

[76] Inventor: Matti J. Sirén, Gartenstrasse 15, CH-8002 Zürich, Switzerland

[21] Appl. No.: 97,703

[22] Filed: Nov. 27, 1979

[30] Foreign Application Priority Data

Nov. 30, 1978 [FI] Finland ..... 783678
Dec. 15, 1978 [SE] Sweden ..... 7812935

[51] Int. Cl.[3] ..... A24D 3/02; A24D 3/08; A24D 3/10; A24D 3/12

[52] U.S. Cl. ..... 131/332; 131/342

[58] Field of Search ..... 131/269, 261 R, 262, 131/263, 331, 332, 334, 341, 342, 344, 345

[56] References Cited

U.S. PATENT DOCUMENTS 4,062,368 12/1977 Crellin et al. ..... 131/332
4,202,356 5/1980 Digenis et al. ..... 131/332

FOREIGN PATENT DOCUMENTS 1964784 7/1970 Fed. Rep. of Germany ..... 131/332

*Primary Examiner*—V. Millin
*Attorney, Agent, or Firm*—Fleit & Jacobson

[57] ABSTRACT

A filter material for removing at least one given substance from an at least substantially gaseous medium, such as tobacco smoke, comprises a cross-linked carbohydrate polymer which is swellable to a given degree and which has the form of an open-pore three-dimensional micro-porous network, there being substantially uniformly distributed therein at least one agent able to remove said substance in a substantially selective manner from the medium passing through the filter.

22 Claims, No Drawings

FILTER MATERIAL

The present invention relates to a filter material for purifying at least substantially gaseous media from at least one pre-determined substance. The invention also relates to filters including such filter material, and to the use of such filter material.

A large number of different filter constructions and filter material have been proposed in recent years for filtering tobacco smoke and other at least substantially gaseous media.

One of the aims in the manufacture of cigarettes is to ensure that that part of the cigarette smoke which is inhaled does not exceed certain optimized limit values in respect of such harmful substances as tar, nicotine and carbon monoxide. This aim has created serious problems in the manufacture of cigarettes, since the concentration, for example, of tar, nicotine and carbon monoxide varies with, for example, the choice of raw tobacco, the place where the tobacco was grown, the conditions under which it was stored etc. The problem is further accentuated when taking into consideration the spectrum of varying factors influencing different tobacco harvests from within the same regions, with respect to such harmful substances as cadmium for example. It shall also be remembered that cigarette smoke shall contain aromatic substances and other pleasant properties in suitable quantities and proportions after the smoke has been drawn through a filter.

Those filter materials produced for separating harmful substances from tobacco smoke have been far from satisfactory. This is understandable when considering the difficult filtering conditions prevailing in, for example, the filtering of tobacco smoke. Tobacco smoke can be considered as an aerosol, and contains $10^3$–$10^{10}$ particles per $cm^3$, the particle diameter then varying from $<0.1$ μm to about 1 μm and the mean diameter of the particles under normal conditions reaching to 0.5–0.6 μm. The particle phase formed in the smoke by these particles constitutes about 5–10% of the weight of the smoke, while the remaining approximately 90–95% of the smoke constitutes a gas phase comprising mainly oxygen, nitrogen, carbon monoxide and carbon dioxide. The velocity of the smoke as it passes through a cigarette filter can be as high as about 35 cm/sec. and the residence time of the smoke during which it can be brought into contact with the filter material is consequently only in the order of magnitude of 0.04 seconds, in the case of a cigarette filter of normal length. The temperature of the cigarette smoke reaching the filter increases as the burning tip of the cigarette approaches said filter, from about room temperature to 75°–90° C.

Modern tobacco-filter materials normally comprise, e.g., gas-permeable organic material, primarily cellulose acetate fibres, or activated carbon.

Combinations of these materials are widely used. When using conventional organic filter material the particles are removed from the tobacco smoke by substantially mechanical processes, since this material is not able to remove harmful substances present in gas phase.

Thus, filters comprising cellulose ester fibres generally function by capturing part of the particulate material in the smoke which passes between the fibres. Crimping or like deformation of the fibres in the filter serves to increase the surface of the fibres forming the smoke-contacting surfaces. Thus, filters which solely comprise such fibres will not remove from the tobacco smoke any appreciable quantities of undesirable components in the gas phase.

To enable the fibres to capture particulate material more effectively, various substances have been applied onto the synthetic fibres used in filters.

Attempts along these lines, however, have not provided the desired effect.

The use of filter materials comprising activated carbon have afforded certain advantages, as a result of the ability of activated carbon to adsorb harmful substances present in gas phase. One disadvantage with activated-carbon filters, however, is their low selectivity; that is to say such filters will also adsorb from the gas phase flavoring substances and nicotine compounds, i.e. compounds which a smoker craves and desires, which may lead to an increased tobacco or cigarette consumption. Consequently, the amount of activated carbon in, for example, a cigarette filter must be limited and hence the capacity of the filter with respect to its ability to adsorb other, undesirable constituents in the tobacco smoke is reduced.

Admittedly it is possible by increasing the amount of activated carbon in a cigarette filter to remove sufficient quantities of certain harmful substances, although at the same time the resistance to suction of the filter is also increased, mainly due to the pocket-like pores of the activated carbon. At the same time the smoke phase is contaminated with a carbon taste.

In addition to the aforedescribed filters, it has been proposed for the purpose of filtering tobacco smoke and other, at least substantially gaseous media, to use filter constructions and filter material which incorporate as active media organic substances, such as metal groups and/or organic salts. These media have either functioned themselves as filter material or have been bound to carrier material, such as activated carbon, various types of fibre, cellulose, cellulose derivatives etc. These filter constructions and filter material, however, have not proved very successful, since a high degree of efficiency is required during the short contact time between filter material and the gaseous medium, and since the space available for the accommodation of filter material has been limited, such as is the case for example with cigarette filters.

One important disadvantage with filter arrangements or filter substances used hitherto has resided in the fact that their active surface area has not been sufficiently great for effective filtering and, at the same time, for permitting them to incorporate or to be infiltrated by active agents. Consequently, attempts have been made to increase the filtering efficiency. These attempts resulted in the use, inter alia, of so-called plasticides for binding together cellulose acetate fibres, or for binding various fibre structural units to form a network. These attempts have not been successful, because in the best of cases all that has been achieved is a network system in macro-scale of small three-dimensional surfaces, i.e. predominantly bonds between individual fibres.

By, for example, treating cellulose or cellulose froth, constituting an aqueous slurry of cellulose fibres and then treating the mass with a water-resistant polymerisate film, it is possible to obtain a type of three-dimensional space network, although this down-like product does not contain pre-determined three-dimensional cavities, but comprises instead a spectrum of cavities and interstices of various sizes which cannot be equated with equally sized pores which extend in uniform distribution from surface to surface.

What is in actual fact required, and which characterizes the invention as an object of the present patent application are cross-links between polymerized molecules or molecular structures, such as to obtain a highly effective capillary network-like matrix produced in a manner such that it is possible to pre-determine the three-dimensional structure of the capillary-network-matrix (its capillary system) by selection of the degree of cross-linking.

The object of the present invention is to provide a novel and advantageous filter material with which the aforementioned disadvantages are substantially eliminated.

To this end it is proposed in accordance with the invention that a filter material for purifying a gaseous or substantially gaseous medium, particularly tobacco smoke, of at least one pre-determined substance, especially cadmium compounds and/or carbon monoxide, includes a cross-linked polymeric carrier material which is swellable to a pre-determined degree and which has the form of an open-pored three-dimensional network having substantially uniformly distributed therein at least one agent having the ability to substantially selectively remove said substance from the medium passing through said filter. The aforementioned disadvantages and other disadvantages are avoided by means of the invention, said invention providing an effective inexpensive filter material which can be readily produced industrially and which comprises a porous basic or skeleton substance having open, through-passing pores, in and on which skeleton substance reactive or catalytically reactive substances such as active metal groups or compounds and/or organic compounds, and also substances such as menthol or therapeutically active agents which shall be admixed with the medium filtered by means of the filter material, can be particularly uniformly distributed in a surprisingly simple and precisely reproduceable manner. Thus, by means of the invention it is also possible to add to the smoke any desirable substance, such as a flavoring or aromatic substance, and to balance and control the composition of the smoke with regard to the taste thereof.

The active substance or substances can be bound to the skeleton substance in any desired manner, either prior to, during or subsequent to the cross-linking reaction, there being used to this end one or more cross-linking agents, e.g. bifunctional compounds, such as epichlorohydrine, dichlorohydrine, diepoxybutane etc., or ionized radiation. The active substance or substances is or are suitably added in a quantity of 2–50%, preferably 5–35%, calculated on the weight of the filter material, said compounds being bound to the skeleton substance chemically, e.g. to anionic groups of the skeleton substance or the starting material therefor, or may be incorporated in the skeleton substance by infiltration. Combinations of these binding materials are also possible. The pore size and total specificity can be adjusted to any desired value or to an optimal value in relation to the amount of active substance to be incorporated in the filter material, and in relation to those conditions under which the filter material can be used, by suitable selection of starting material and the degree of cross-linking.

The cross-linked polymeric material may comprise a cross-linked polymer containing hydroxyl groups, suitably a cross-linked carbohydrate polymer, a cross-linked polyhexose or a cross-linked polyhexose derivative being at present preferred. The polyhexose or polyhexose derivative may comprise or originate from natural or synthetic carbohydrate polymers, such as cellulose, starch or inulin or dextran, respectively, or mixtures thereof.

The metals primarily of interest according to the invention comprises Ca, Mg, Ba, Fe, Al, Cu and the transition metals, particularly the transition metals Ti, V, Cr, Mn, Fe, Co, Ni, Mo and Pd, the metal or metals included in the filter material being selected with a starting point from the selective properties particularly desired in the filtering process in question. The term "metal" as used herein and in the accompanying claims is used to designate a metal by itself as well as compounds thereof. In this respect metals or metal compounds can be selected which exert a catalytic activity on specific harmful compounds in the medium filtered by the filter material, in a manner such that these harmful compounds are decomposed or combined to less harmful or innocuous compounds. Among such harmful compounds present in tobacco smoke are found carbon monoxide and hydrogen cyanide and carcinogenic substances, such as phenol, catechol, resorcinol and benzopyrene.

One filter material according to the invention is particularly suited for removing cadmium-containing compounds from substantially gaseous media, in particular tobacco smoke, and includes as an active substance at least one calcium compound, suitably in the form of a free inorganic calcium salt, although calcium may also be chemically bound to anionic groups, particularly carboxyl, sulphonic acid or phosphoric acid groups in the skeleton substance comprising cross-linked polymer. The amount of calcium in the filter material may, to advantage, reach to 2.5–25% of the weight of filter material.

One filter material according to the invention having the ability of removing carbon monoxide from substantially gaseous media, in particular from tobacco smoke, includes, to advantage, iron and/or copper in oxidized form or in chloride form, causing the carbon monoxide in the medium flowing through the filter material to be oxidized to carbon dioxide.

Conveniently a filter material according to the invention for filtering tobacco smoke includes both calcium compounds and iron and/or copper compounds, the content of iron and/or copper preferably exceeding one tenth of the calcium content.

Preferably the filter material is in particle form, comprising primarily spherical grains and granules, for example having the form of balls or cylinders with a cross dimension of 0.005–3 mm, whereby the manufacture of a filter consisting of said filter material or containing said filter material with a desired, pre-determinable resistance to flow therethrough can be facilitated by suitable selection of the shape and size of the granules.

The filter material according to the invention can be used in combination or in mixture with other materials normally used or useable as filter material. For example the filter material according to the invention can conveniently be combined or mixed with particles or granules of a filter material comprising solely a cross-linked polymeric, porous material and/or particles or granules of activated carbon, suitably activated carbon obtained by pyrolysis and activation of an aforedescribed filter material including active substance. The aforementioned additives can be used for complementing the properties of the filter material, e.g. for adjusting the total adsorption ability of said filter material and its hydrophilic and hydrophobic properties. These latter properties can also be altered or adjusted by suitable selection, inter alia, of the composition of the skeleton substance.

The main object of the filter or filter system according to the invention, which is suitable for treating gaseous media and in particular for treating aerosols, particularly within the limited volume which, e.g. is available in a cigarette filter, are as follows:

1. The removal of harmful substances from smoke
2. The removal of decisive quantities of tar-like constitutents from the smoke.
3. The removal from smoke of pre-determined quantities of alkaloids.
4. The removal of irritating substances from the gas phase of the smoke.
5. The retention of satisfactory quantities of flavoring and aromatic substances in the smoke, and even the improvement of the taste-quality of the smoke.

These primary objects of the invention are achieved in consequence of the following:

The tar-like and particulate components are removed from the smoke by providing a large suitable surface against which these components can impinge. Filter constructions known hitherto have not been adequate in this respect, while retaining adequate resistance to suction. Admittedly the majority of activated carbon filter constructions have had a sufficiently large filtering surface per se, but since a large number of the pores of the carbon particles do not extend from surface to surface, as is desirable, but form culdesacs, part of the filtering surface is relatively inactive.

The filter material according to the invention provides a number of completely surprising, positive effects, owing to the fact that the carrier material contains agents which produce adsorption and/or adsorption and remove a number of irritating gaseous substances. The filter may contain surfactants which cooperate to remove toxic substances from smoke. Alkaloids and other components can be removed by suitable chemical reaction with substances present in the filter, which substances are chemically combined with the alkaloids and said other components to form compounds which are retained in the filter structure. It has been found particularly suitable to treat the surfaces of granular particles with a suitable surface membrane substance, e.g. with cellulose acetate or the like.

Special selective properties can also be obtained by coating a given percentage of the particles or granules of the filter material or of said filter-material additives with a semipermeable layer of organic material, for example a layer of cellulose acetate.

It is known that the irritating effect on the mucous membrane in conjunction with cigarette smoking is at least partially due to the presence in the gas phase of such compounds as aldehydes, sulphides, hydrogen cyanide etc. The filter according to the invention removes substantial quantities of these compounds. Phenols and acid materials, which are known to be present in tobacco smoke and which are thought, with reason, to be harmful, are also removed in considerable quantities.

The filter according to the invention includes an extensive agent for physical and chemical treatment of smoke, including regulating the pH by removing acid components and fixing or binding harmful substances.

A decisive factor in this respect is that in accordance with the invention the concentration of the active substances and their mutual proportions in the filter matrix can be widely varied.

The manufacture of a filter material according to the invention will now be described with reference to the following examples.

EXAMPLE 1

A filter material having the ability to remove cadmium from tobacco smoke was manufactured in accordance with the following:

100 grams of dried cross-linked chromatographic gel having a particle size in dry state of from 0.5–0.75 mm and a maximum swellability of 5 ml/gram was slurried by carefully stirring said gel in 700 ml of distilled water at a temperature of 30° C., whereafter the gel was left to stand for 5 hours. The supernatant water (about 200 ml) was then decantered and an amount of 10% calcium chloride solution corresponding to the amount of water decantered was added. The gel together with the added calcium chloride solution was then carefully stirred for 2 hours and then left to stand for 1 hour, in order to allow the gel to settle. The supernatant solution was then decantered, whereafter the gel particles which had settled were filtered and dried, first at a temperature of 50° C. for 24 hours, and then at a temperature of 75° C. for 10 hours, and finally at a temperature of 85° C. for a further 10 hours. The gel particles were then transferred to a Büchner-funnel and finally dried at a subpressure and at a temperature of 40° C. for one hour. It could be established that the grain form was substantially unchanged, while the swellability was found to have decreased from an original 5 ml/gram to about 2 ml/gram.

EXAMPLE 2

Several other cross-linked gels in the form of particles having approximately the same particle size as the gel used in Example 1 but a maximum swellability varying between 5 and approximately 20 ml/gram were treated substantially in accordance with Example 1. Upon such treatment their swellability decreased by about 50 to 60%.

Other examples of embodiments of the invention are given below.

For testing the filter material with regard to its capability of removing cadmium from cigarette smoke, the following experiments were made.

1000 ml of a soil was put into each of a number of plastic pots. Radioactive $Cd^{109}$ was added as the chloride to the soil in each pot in an amount corresponding to approximately 50 microcurie. In each pot two tobacco plants (Virginia) were grown from seed for about 4 to 6 months in a laboratory green-house. The water lost was made up at intervals by watering the pots to their original weight. Different parts of the tobacco plants were harvested separately and air-dried. The radioactive $Cd^{109}$ tobacco was blended with commercial tobacco in proportion 1 to 10 and cigarettes were made from said tobacco blend and were provided with either commercial cellulose acetate filters of a weight of approximately 200 milligram or filters of approximately the same weight but comprising a cross-linked polyhexose derivative to which had been added $Ca_2HPO_4$ substantially in the manner described in Example 1. The maximum swellability of said filter material amounted to approximately 4 ml/gram.

The radioactivity of such cigarettes was measured and the cigarettes were then smoked, all in the same manner, in a smoking machine. The amount of smoke which was lost in the side stream and, thus, did not pass through the filter of respective cigarette, amounted to about 30 to 35%. The radioactivity of the filters of the smoked cigarettes was thereafter measured by a Well-crystal isotope counter. The result of said measurement are given in Tables 1 and 2 below, in which radioactivity values are mean values of three analyses performed and in which netto counts means actual counts minus counts due to background radioactivity.

TABLE 1

| Radioactivity in five cigarettes containing $Cd^{109}$ (Netto counts per 100 sec.) | Radioactivity in cellulose acetate filter after smoking (Netto counts per 100 sec.) |
|---|---|
| 15 892 | 720 |
| 15 172 | 450 |
| 14 236 | 729 |
| 13 783 | 307 |
| 12 978 | 567 |
| (Background radioactivity: 620 ± 37 counts per 100 sec.) | |

TABLE 2

| Radioactivity in five cigarettes containing $Cd^{109}$ (Netto counts per 100 sec.) | Radioactivity in filter made according to the present invention after smoking (Netto counts per 100 sec.) |
|---|---|
| 13 768 | 7 805 |
| 12 978 | 8 672 |
| 11 234 | 6 078 |
| 11 701 | 7 362 |
| 12 503 | 8 117 |
| 12 675 | 7 018 |
| (Background radioactivity; 678 ± 37 counts per 100 sec.) | |

The amount of smoke that was lost in the side stream (normally about 30 to 35% by volume) was not analyzed, and therefore, if we like to calculate the total effectiveness of this filter construction it is of course necessary to analyze the composition of this amount.

The results given in Tables 1 and 2 show that the cellulose acetate filter is inefficient with regard to adsorbtion of cadmium while the calcium containing filter material is very efficient in this respect. The amount of cadmium in the side stream was not measured but it can be calculated from other investigations that this amount is at least approximately 30%.

In accordance with one particular embodiment of the invention the filtering and through-flow properties of the novel filter substance can be further increased if desired, by adding to or infiltrating the matrix preparation or the formed particles with, e.g., $(NH_4)_2CO_3$ in aqueous solution in suitable concentration, and removing $(NH_4)_2CO_3$, $NH_4HCO_3$ during the manufacturing process by, e.g., a controlled heat-treatment step. In this process, $NH_3$, $H_2O$ and $CO_2$ are removed from the granules in gas form, there being formed extremely porous and spiky granules which exhibit surprisingly good gas-permeability while retaining an effective filtering ability. It is also possible to use other salts and compounds, such as ammonium carbamate, $NH_2COONH_4$, ammonium phosphate, $(NH_4)H_2PO_4$. By such infiltration and by selection of suitable readily volatile substituents, it is possible to obtain filter granules having a large and predeterminable internally variable space structure. When using ammonium carbonates, for instance, it is possible by controlling the temperature gradient and the pressure conditions during said heat-treatment and, thus, by controlling the evaporation of gas, to increase the porosity and hence the gas-permeability of the filter material by up to 200%.

In accordance with a special embodiment of the invention, the filter substance is also characterized in that it comprises a carrier substance comprising a cross-linked polymer, said carrier substance having a low suction resistance and a large and effective filtering surface for catalytically active redox groups, i.e. reduction-oxidation systems. The catalytically active reduction-oxidation-system used may comprise, e.g. iron and copper compounds.

EXAMPLE 3

To cross-linked gels of the type described in Examples 1 and 2 were added iron and/or copper compounds in such amounts that Fe and/or Cu, in catalytically active form, comprised 15% by weight of the Ca content of the final filter material.

Investigations made on cigarette smoke from cigarettes according to the above Tables 1 and 2 and filtered through this filter material showed a reduction of carbon monoxide content by 50 to 55% on average in comparison to the carbon monoxide content of the smoke from the cellulose acetate filter-tipped cigarettes. Practically the same results were obtained when omitting the content of Ca in the filter material.

In accordance with a special embodiment of the invention there is introduced into the cross-linked polymeric porous material a given number of sulph-hydryl groups, said polymeric material being based, for example, on starch, cellulose, dextrans and/or their hydroxyl alkylated or esterified or etherized derivatives. This embodiment is described in the following examples. By the aid of such sulph-hydryl groups it is possible to bind to the filter material skeleton compounds which in turn are capable of binding detrimental components present in, e.g., cigarette smoke passing through the filter material.

In accordance with a particularly suitable embodiment of the invention—which has been shown to provide surprisingly good filtering effect—the cross-linked filter substance is substituted with, e.g., 2-hydroxyalkyl groups or other groups capable of enhancing the lipophilic character of the final filter material, there being obtained a filter material having good general filtering properties, low resistance to suction and a greater lipophilic character which enhances the capability of the filter material to take up hydrophobic compounds from, e.g., cigarette smoke passing through the filter material.

In accordance with a further suitable embodiment of the invention there is infiltrated in the filter substance of the filter, said filter substance having a granular form with an average particle size of between 50–500 μm, preferably about 100–300 μm, a trisodium-orthophosphate, by slurrying the granules in an aqueous solution of trisodium-orthophosphate at a temperature of 20° C. and then drying said granules and applying them to a smoking article. This embodiment has shown surprisingly good results in the removal of acid and phenol components from cigarette smoke.

EXAMPLE 4

Filter tips having a length of 15 mm, a weight of approximately 200 milligram and comprising equal parts of the cellulose acetate tow and a particulate filter substance according to the invention which had been saturated with trisodium-orthophosphate, were produced and attached to test cigarettes. These were smoked in a smoking machine taking two puffs at a duration of two seconds each minute. The smoke volume of each puff amounted to 35 ml. The amount of volatilizable phenols removed by this type of filter from the smoke passing therethrough was calculated and compared with the amount of phenols removed by filters comprising solely approximately 200 milligram cellulose acetate tow when smoking similar cigarettes in the same manner. By the filters containing said trisodium-orthophosphate the removal of phenols increased between 35 and 44%.

By being able to guarantee and control beforehand the quantity of active component in the cross-linked material, in which the active component is uniformly distributed, it has been possible to obtain filtering effects which have not hitherto been possible in practice. The active component can also comprise alkalimetal compounds and earth alkalimetal compounds capable of reducing the amount of detrimental substances and reducing the total amount of tar from, e.g., cigarette smoke.

In accordance with an embodiment of the invention, the cross-linked filter substance is substituted with, e.g., an aromatic substance or some other desirable additive, e.g. to an inclusion complex which comprises a carrier group and/or a carrier compound and/or an aromatic substance and from which the aromatic substance added thereto is released during smoking when the tobacco smoke passes through said filter.

The particulate filter material according to the invention has a suitable particle size which predominantly is about 10–800 μm and preferably predominantly between about 50–400 μm. It has been found that a particle size between 50 and 300 μm provides the best results, although variations may be desirable in dependence upon the proportions between possible other components, such as components of the type cellulose acetate fibre, carbon filter material, etc. Thus, particle sizes of from 0.1 mm–2 mm have been found suitable in certain filter constructions.

The modifiable carrier matrix of the invention comprises a cross-linked polymeric carrier material in the form of a pre-controllably swellable matrix forming a pre-controllable dimensioned and uniformly distributed open-pored capillary pore system in a three-dimensional network material, the carrier matrix, said pores extending from surface to surface and the swellability of said carrier matrix being varied, e.g., between approximately 2–50 ml, preferably between 3–20 ml, per gram of dry filter mass, said filter mass being used with at least one active substance substantially uniformly distributed therein for filtering gaseous media.

The invention is not restricted to the given examples, but can be modified within the scope of the following claims. For example, the filter material may be provided with additives for adjusting the pH of the medium passing through the filter to a desired value.

A decisive factor in this connection is that the invention permits wide variation, particularly with respect to the concentration and mutual proportion of active substances in the filter material.

I claim:

1. Filter material for removing at least one predetermined substance from an at least substantially gaseous medium, wherein said filter material comprises a carrier material comprising a cross-linked carbohydrate polymer, which is swellable to a predetermined degree and has the form of a micro-porous network having through-passing pores defined by the cross-linked carbohydrate molecule structures, said carrier material having uniformly distributed therein at least one agent capable of removing said substance in a substantially selective manner from the medium passing through said filter.

2. A filter material according to claim 1, wherein the cross-linked carbohydrate polymer is a member of the group consisting of cross-linked polyhexoses and cross-linked polyhexose derivatives.

3. A filter material according to claim 2, wherein said polyhexose respectively said polyhexose derivative comprises or originates from natural carbohydrate polymers or synthetic carbohydrate polymers or mixtures thereof.

4. A filter material according to claim 3, wherein said natural carbohydrate polymer is cellulose, starch or inulin.

5. A filter material according to claim 3, wherein said synthetic carbohydrate polymer is dextran.

6. A filter material according to claim 1, wherein the carrier material is swellable in a liquid which is also present in liquid or vapor form in the medium to be filtered by means of the filter material.

7. A filter material according to claim 1, wherein said agent comprises at least one metal from the group Ca, Mg, Ba, Al, Cu, transition metals and alkali metals.

8. A filter material according to claim 1, wherein said agent comprises at least one calcium compound.

9. A filter material according to claim 8, wherein said calcium compound is in the form of free inorganic calcium salt.

10. A filter material according to claim 1, wherein said agent comprises at least one metal from the group consisting of iron and copper in catalytically active groups in a reduction-oxidation system.

11. A filter material according to claim 1, wherein said filter material has the form of discrete or mutually bound particles or granules, the shape of which is predetermined and the pores of which are uniformly distributed in and extend from surface to surface through the particles and granules, respectively.

12. A filter material according to claim 11, wherein said filter material exists in combination or mixture with particles or granules of a porous material comprising solely a cross-linked polymer.

13. A filter material according to claim 11, wherein said filter exists in combination or mixture with particles or granules of activated carbon.

14. A filter material according to claim 13, wherein said activated carbon is one obtained by pyrolysis and activation of a cross-linked carbohydrate polymer which is swellable to a predetermined degree and has the form of a micro-porous network having through-passing pores defined by the cross-linked carbohydrate molecule structures.

15. A filter material according to claim 11, 12, or 13 wherein at least a certain percentage of the particles or granules are coated with a semipermeable layer of organic material.

16. A filter which contains a filter material according to any of claims 1, 8, 12 and 13.

17. The use of a filter material according to any of claims 1, 8, 12 and 13 for filtering an at least substantially gaseous medium.

18. The use of a filter material according to any of claims 1, 8, 12 and 13 for filtering tobacco smoke.

19. A filter material according to claim 1, wherein said agent is present in a quantity of 2–50% calculated on the weight of the filter material.

20. A filter material according to claim 1, wherein said agent is present in a quantity of 5–35% calculated on the weight of the filter material.

21. A filter material according to claim 8, wherein the amount of calcium in the filter material is 2.5–25% of the weight of the filter material.

22. A filter material according to claims 11, 12 or 13, wherein at least a certain percentage of the particles or granules are coated with a semipermeable layer of cellulose acetate.

* * * * *